US009042767B2

(12) United States Patent
Nakai et al.

(10) Patent No.: US 9,042,767 B2
(45) Date of Patent: May 26, 2015

(54) IMAGE FORMING APPARATUS HAVING A DRUM HEATER

(71) Applicant: KYOCERA DOCUMENT SOLUTIONS INC., Osaka (JP)

(72) Inventors: Jun Nakai, Osaka (JP); Eiji Gyotoku, Osaka (JP); Masahito Ishino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/179,234

(22) Filed: Feb. 12, 2014

(65) Prior Publication Data

US 2014/0233978 A1 Aug. 21, 2014

(30) Foreign Application Priority Data

Feb. 15, 2013 (JP) ..... 2013-027575

(51) Int. Cl.
*G03G 15/00* (2006.01)
*G03G 21/06* (2006.01)

(52) U.S. Cl.
CPC ..... *G03G 15/50* (2013.01); *G03G 15/657* (2013.01); *G03G 21/06* (2013.01)

(58) Field of Classification Search
USPC ..... 399/96
See application file for complete search history.

(56) References Cited

U.S. PATENT DOCUMENTS 4,720,727 A * 1/1988 Yoshida ..... 399/93
4,737,822 A * 4/1988 Taniguchi et al. ..... 355/400
5,321,476 A * 6/1994 Gross ..... 399/66
5,689,768 A * 11/1997 Ehara et al. ..... 399/96
6,266,495 B1 * 7/2001 Yuminamochi et al. ..... 399/66
8,335,450 B1 * 12/2012 Daloia et al. ..... 399/96
2006/0140663 A1 * 6/2006 Matsuura ..... 399/96
2007/0147861 A1 * 6/2007 Takayanagi ..... 399/45
2007/0212625 A1 * 9/2007 Suzuki et al. ..... 430/58.7
2008/0260398 A1 * 10/2008 Itoh ..... 399/44
2012/0321347 A1 * 12/2012 Daloia et al. ..... 399/128

FOREIGN PATENT DOCUMENTS

JP 03279989 A * 12/1991 ..... G03G 21/00
JP 08076641 A * 3/1996 ..... G03G 21/00
JP 08160821 A * 6/1996 ..... G03G 21/10
JP 08171337 A * 7/1996 ..... G03G 21/20
JP 2006106709 A * 4/2006
JP 2007-264167 A 10/2007

* cited by examiner

*Primary Examiner* — David Bolduc
(74) *Attorney, Agent, or Firm* — Studebaker & Brackett PC

(57) ABSTRACT

An image forming apparatus includes an image bearing member, a charging unit, a laser scanning unit, a developing unit, a transfer member, a recording medium conveyance path, a cleaning unit, and a heating element. The recording medium conveyance path includes a resin member that forms a conveyance surface. The resin member has a concave portion at a location closer to the transfer member than to the image bearing member. The heating element for heating the image bearing member is accommodated in the concave portion. The heating element is disposed downstream from the contact point between the image bearing member and the transfer member in the conveyance direction in which a recording medium is conveyed through the recording medium conveyance path. The developing unit is located upstream from the contact point between the image bearing member and the transfer member in the conveyance direction of the recording medium.

10 Claims, 6 Drawing Sheets

IMAGE FORMING APPARATUS HAVING A DRUM HEATER

INCORPORATION BY REFERENCE

The present application claims priority under 35 U.S.C. §119 to Japanese Patent Application No. 2013-027575, filed Feb. 15, 2013. The contents of this application are incorporated herein by reference in their entirety.

BACKGROUND

The present disclosure relates to image forming apparatuses, such as electrographic copiers, printers, and facsimile machines, as well as multifunction peripherals combining their functions.

Recent years, amorphous silicon (a-Si) photosensitive drums have been widely used as an image bearing member for an image forming apparatus utilizing an electrographic process. An a-Si photosensitive drum has high hardness and excellent durability, and its characteristics as a photosensitive member are substantially without degradation even after a prolonged usage. Therefore, high image quality can be maintained. That is to say, an a-Si photosensitive drum is an excellent image bearing member for its low running cost, easy handling characteristics, and high level of safety to the environment.

An image forming apparatus using such an a-Si photosensitive drum is known to involve a greater risk of image deletion owing to the characteristics of the a-Si photosensitive member. Image deletion refers to a phenomenon in which an image is blurred or smudged. Image deletion occurs when ion products adhere to the surface of the photosensitive drum and the ion products absorb moisture from the atmosphere. In particular, when the surface of the photosensitive drum is charged by a charging unit, nitrogen oxide (NOx) adheres to the surface of the photosensitive drum. The nitrogen oxide absorbs moisture, causing the latent charges to flow along the surface on which the latent image is formed. As a result, image deletion occurs in the electrostatic latent image formed on the surface of the photosensitive drum. Image deletion tends to occur especially at the edge portions of an electrostatic latent image.

Various methods have been suggested to reduce occurrence of image deletion. In one example, a heating element (heater) is provided inside the photosensitive drum, and a hygrothermograph sensor is provided inside the image forming apparatus. The heating element is heated based on the temperature and humidity measured by the hygrothermograph sensor. With this arrangement, even if moisture adheres to the surface of the photosensitive drum, the moisture can be evaporated. Consequently, occurrence of image deletion can be prevented.

Unfortunately, in the case where the heater is provided inside the photosensitive drum, a sliding electrode is required to connect the heater and the power supply. Therefore, there is a sliding portion connecting the heater to the power supply. As the total rotation time of the photosensitive drum is prolonged, connection failure may occur at the sliding portion.

In view of the above, a suggestion is made to provide the heating element in a static eliminating section. In particular, the static eliminating section includes a substrate, a light-emitting element, and a heating element. The light-emitting element is attached to one main surface of the substrate and emits light toward the photosensitive drum. The light emission by the light-emitting element eliminates the charges on the photosensitive drum. The heating element is disposed on the other main surface of the substrate. The heating element heats the photosensitive drum.

SUMMARY

An image forming apparatus according to one aspect of the present disclosure includes an image bearing member, a charging unit, a laser scanning unit, a developing unit, a transfer member, a recording medium conveyance path, a heating element, and a cleaning unit. The image bearing member includes a photosensitive layer. The charging unit charges a surface of the photosensitive layer by applying a charging bias to the surface of the photosensitive layer. The laser scanning unit forms an electrostatic latent image on the photosensitive layer by scanning light on the surface of the photosensitive layer, the surface having been uniformly charged by the charging unit. The developing unit includes a developing-agent bearing member. The developing-agent bearing member has an outer peripheral surface. The developing-agent bearing member bears a developing agent on the outer peripheral surface. The developing unit forms, on a surface of the image bearing member, a toner image conforming to the electrostatic latent image by using the developing-agent bearing member to cause toner to adhere to the surface of the image bearing member. The transfer member transfers the toner image formed on the surface of the image bearing member by the developing unit to a recording medium. The recording medium conveyance path is disposed between the transfer member and the image bearing member. The recording medium is conveyed through the recording medium conveyance path. The recording medium conveyance path includes a resin member that forms a conveyance surface. The resin member has a concave portion at a location closer to the transfer member than to the image bearing member. The heating element is accommodated in the concave portion and heats the image bearing member. The heating element is disposed downstream from the contact point between the image bearing member and the transfer member in the conveyance direction in which the recording medium is conveyed through the recording medium conveyance path. The cleaning unit removes residual toner from the surface of the image bearing member. The charging unit, the developing unit, the transfer member, and the cleaning unit are disposed in the stated order in a rotation direction of the image bearing member. The developing unit is located upstream from the contact point between the image bearing member and the transfer member in the conveyance direction of the recording medium.

DETAILED DESCRIPTION

The following describes embodiments of the present disclosure, with reference to the accompanying drawings. In the figures, the same or corresponding parts are denoted by the same reference sings, and a description of such parts is not repeated.

Figure 1:
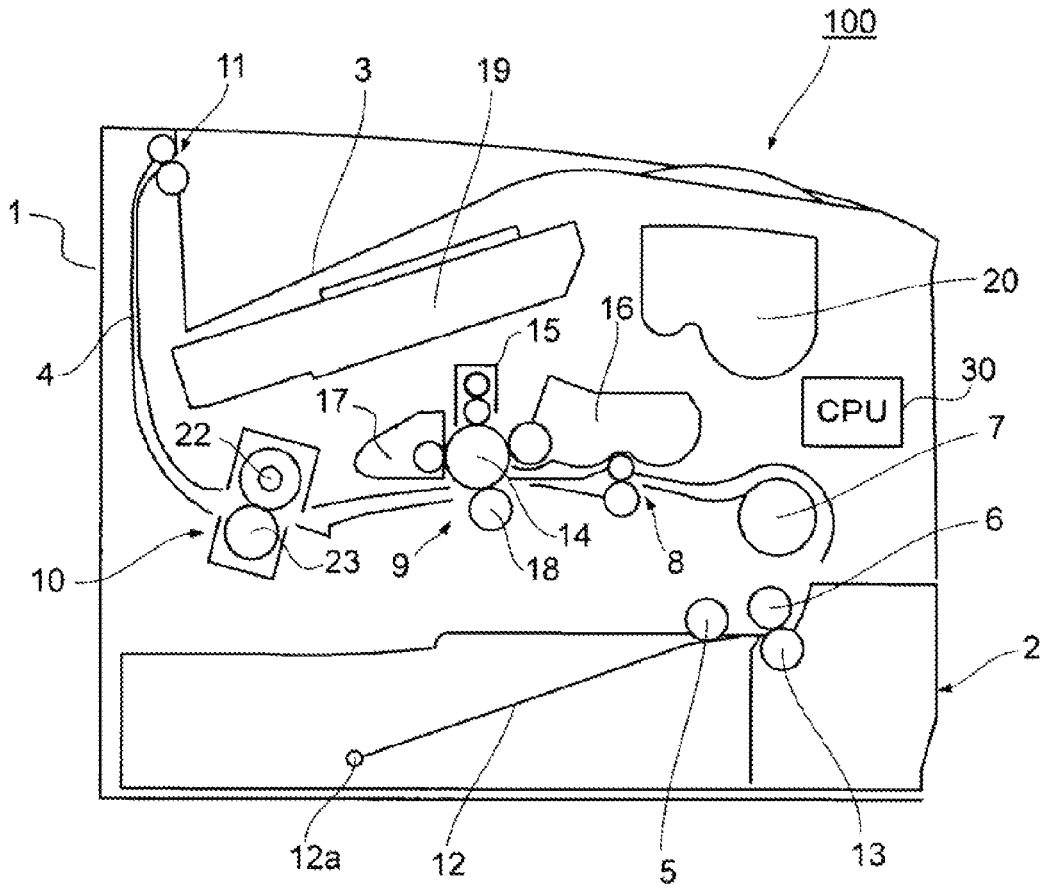
FIG. 1 is a schematic view showing an overall structure of an image forming apparatus according to a first embodiment.

FIG. 1 is a schematic view showing an overall structure of an image forming apparatus 100 according to a first embodiment. The right-hand side in FIG. 1 corresponds to the front side of the image forming apparatus 100. The image forming apparatus 100 is a monochrome printer. As shown in FIG. 1, the image forming apparatus 100 includes a sheet feed cassette 2. The sheet feed cassette 2 is provided at the bottom of a main body 1. The sheet feed cassette 2 stores a stack of sheets. Sheets are one example of a recording medium. Formed above the sheet feed cassette 2 is a sheet conveyance path 4. The sheet conveyance path 4 is one example of a recording medium conveyance path. The sheet conveyance path 4 extends generally horizontally from the front side to the rear side of the main body 1 and then extends upward to reach a sheet ejecting section 3. The sheet ejection section 3 is formed in the upper surface of the main body 1. Along the sheet conveyance path 4, the following are disposed in order from the upstream side in the sheet conveyance path 4: a pickup roller 5, a feed roller 6, an intermediate conveyance roller 7, a registration roller pair 8, an image forming section 9, a fixing unit 10, and an ejection roller pair 11. In addition, the image forming apparatus 100 includes a control section (CPU) 30. The control section 30 controls operation of the respective rollers stated above, the image forming section 9, and the fixing unit 10, and the like.

The sheet feed cassette 2 is provided with a sheet stacking plate 12. The sheet stacking plate 12 is supported to be freely pivotable about a pivotal fulcrum 12*a* relative to the sheet feed cassette 2. The pivotal fulcrum 12*a* is disposed on the rear edge in the sheet conveyance direction. Sheets are stacked on the sheet stacking plate 12. As the sheet stacking plate 12 pivots, the stack of sheets on the sheet stacking plate 12 comes to be pressed by the pickup roller 5. Disposed at a location forward of the sheet feed cassette 2 is a retard roller 13. The retard roller 13 is pressed against the feed roller 6. In the event that the pickup roller 5 simultaneously feeds a plurality of sheets, the sheets are separated by the feed roller 6 and the retard roller 13 so that only the topmost sheet is forwarded.

Having passed through the roller pair made up of the feed roller 6 and the retard roller 13, the sheet is conveyed to the intermediate conveyance roller 7. The intermediate conveyance roller 7 changes the sheet conveyance direction (the recording medium conveyance direction) from the direction toward the front side to the direction toward the rear side of the apparatus. Having passed the intermediate conveyance roller 7, the sheet is conveyed to the image forming section 9 via the registration roller pair 8. The registration roller pair 8 is provided for adjusting the timing for feeding the sheet to the image forming section 9.

The image forming section 9 forms a predetermined toner image on the sheet through an electrographic process. The image forming section 9 includes a photosensitive drum 14, which is one example of an image bearing member, a charging unit 15, a developing unit 16, a cleaning unit 17, a transfer roller 18, which is one example of a transfer member, and a laser scanning unit (LSU) 19. The photosensitive drum 14 is axially supported to be rotatable in the clockwise direction in FIG. 1. The charging unit 15, the developing unit 16, the cleaning unit 17, and the transfer roller 18 are disposed to surround the photosensitive drum 14. The transfer roller 18 is disposed to face the photosensitive drum 14 across the sheet conveyance path 4. The laser scanning unit (LSU) 19 is disposed above the photosensitive drum 14. In addition, a toner container 20 is disposed above the developing unit 16. The toner container 20 supplies toner to the developing unit 16.

In this embodiment, the photosensitive drum 14 is an amorphous silicon (a-Si) photosensitive member. The a-Si photosensitive drum includes a conductive substrate (tubular body) made, for example, of aluminum, an a-Si based photoconductive layer, and a surface protective layer. The a-Si based photoconductive layer is disposed as a photosensitive layer over the conductive substrate (tubular body). The surface protective layer is disposed on the upper surface of the photoconductive layer. The surface protective layer is made from an inorganic insulator or an inorganic semiconductor, such as a-Si based SiC, SiN, SiO, SiON, or SiCN.

When image data is input to the CPU 30 from a higher-level device, such as a personal computer, first, the charging unit 15 uniformly charges the surface of the photosensitive layer included in the photosensitive drum 14. Next, the laser scanning unit (LSU) 19 emits a laser beam based on the inputted image data so as to form an electrostatic latent image on the surface of the photosensitive layer included in the photosensitive drum 14. Then, the developing unit 16 supplies toner to the surface of the photosensitive drum 14. As a result, toner adheres to the surface of the photosensitive drum 14 in conformity with the electrostatic latent image. This forms a toner image on the surface of the photosensitive drum 14. The toner image is then transferred to the sheet fed to a nip portion (transfer position). The nip portion is formed at the contact point between the photosensitive drum 14 and the transfer roller 18. The sheet is fed to the nip portion by the transfer roller 18.

The sheet onto which the toner image has been transferred is separated from the photosensitive drum 14 and conveyed toward the fixing unit 10. The fixing unit 10 is disposed downstream from the image forming section 9 in the sheet conveyance direction. The fixing unit 10 includes a heating roller 22 and a pressure roller 23. The heating roller 22 is one example of a heating member, and the pressure roller 23 is one example of a pressure member. The pressure roller 23 is pressed against the heating roller 22. The sheet to which the toner image has been transferred is heated and pressed by the heating roller 22 and the pressure roller 23. As a result, the toner image transferred to the sheet is fixed. In the manner described above, an image is formed on the sheet by the image forming section 9 and the fixing unit 10. The sheet on which an image has been formed is ejected to the sheet ejecting section 3 by the ejection roller pair 11.

Note that some toner may remain on the surface of the photosensitive drum 14 even after the image transfer. The residual toner is removed by the cleaning unit 17. In addition, after the image transfer, a static eliminating unit 25 (see FIG. 2), which will be described later, eliminates the charges remaining on the surface of the photosensitive layer included in the photosensitive drum 14. Subsequently, the surface of the photosensitive layer included in the photosensitive drum 14 is again charged by the charging unit 15. Thereafter, image formation is performed in the same manner.

Figure 2:
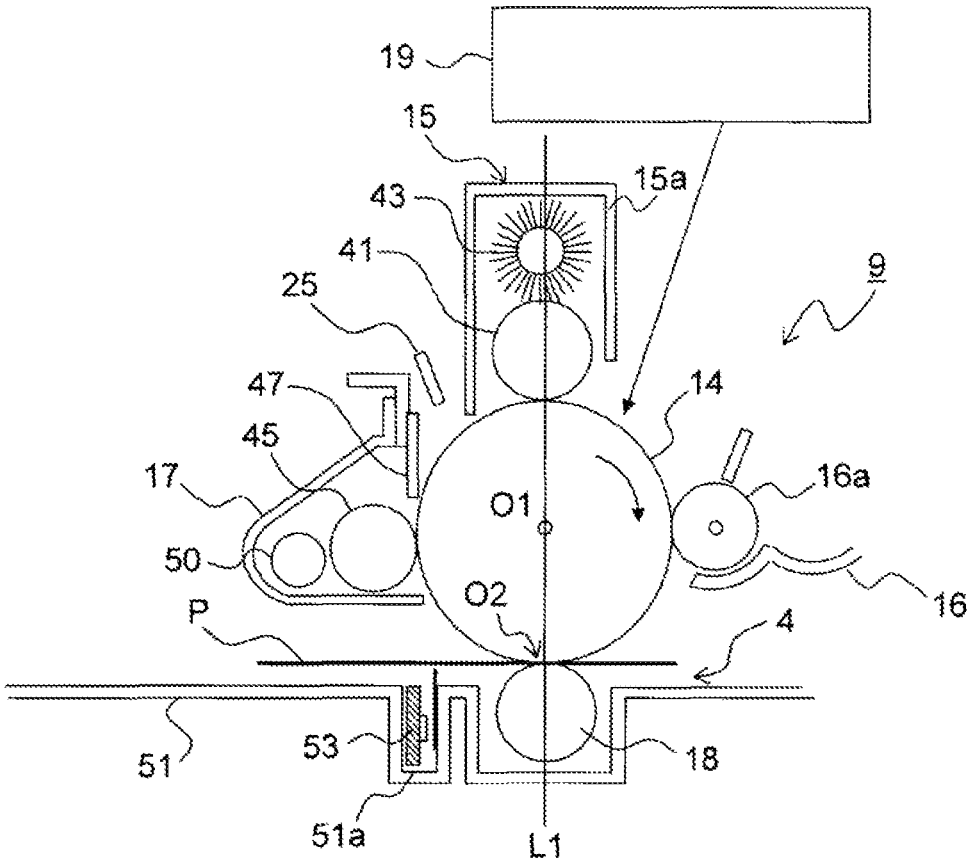
FIG. 2 is a schematic enlarged view showing a portion around an image forming section shown in FIG. 1.
Figure 3:
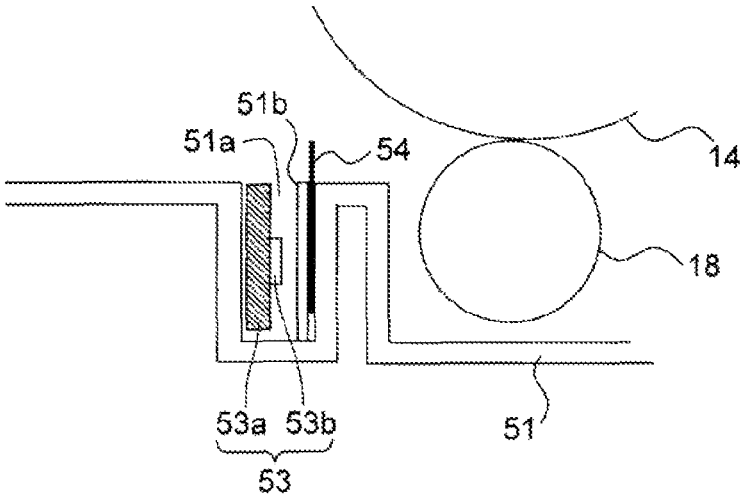
FIG. 3 is a schematic enlarged view showing a portion around a nip portion shown in FIG. 2.

FIG. 2 is a schematic enlarged view showing a portion around the image forming section 9 shown in FIG. 1, and FIG. 3 is a schematic enlarged view showing a portion around the nip portion shown in FIG. 2. The nip portion is formed at the contact point between the photosensitive drum 14 and the transfer roller 18. The charging unit 15 includes a charging housing 15*a*, a charging roller 41, and a charging-roller cleaning brush 43. The charging roller 41 and the charging-roller cleaning brush 43 are accommodated in the charging housing 15*a*. The charging roller 41 is in contact with the photosensitive drum 14 to apply a charging bias to the surface of the photosensitive drum 14. As a result, the surface of the photosensitive layer included in the photosensitive drum 14 is uniformly charged. The charging-roller cleaning brush 43 cleans the charging roller 41. The charging roller 41 is made of conductive rubber. The charging roller 41 is disposed to abut against the photosensitive drum 14. The charging-roller cleaning brush 43 is in contact with the charging roller 41.

As the photosensitive drum 14 rotates in the clockwise direction in FIG. 2, the charging roller 41 that is in contact with the surface of the photosensitive drum 14 is driven to rotate in the counterclockwise direction in FIG. 2. By applying a predetermined voltage to the charging roller 41 at this time, the surface of the photosensitive layer included in the photosensitive drum 14 is uniformly charged. In addition, as the charging roller 41 rotates, the charging-roller cleaning brush 43 that is in contact with the charging roller 41 is driven to rotate in the clockwise direction in FIG. 2. As a result, the charging-roller cleaning brush 43 removes foreign matter adhered on the surface of the charging roller 41.

The fixing unit 16 includes a developing roller 16*a*. The developing roller 16*a* is one example of a developing-agent bearing member. The developing roller 16*a* supplies toner to the surface of the photosensitive drum 14. The supplied toner adheres to the surface of the photosensitive drum 14 in conformity with the electrostatic latent image. To the developing unit 16, toner is supplied (fed) from the toner container 20 (see FIG. 1) via an intermediate hopper (not shown). In this embodiment, the toner contained in the developing unit 16 is a one-component developing agent. The one-component developing agent is made exclusively from a toner component having a magnetic property.

The cleaning unit 17 includes a slide-and-friction roller 45, a cleaning blade 47, and a toner collecting roller 50. The slide-and-friction roller 45 is one example of a polishing member. The slide-and-friction roller 45 is pressed against the photosensitive drum 14 at a predetermine pressure. In addition, the slide-and-friction roller 45 rotates in the counterclockwise direction shown in FIG. 2 by receiving power given by a drum cleaning motor (not shown). As a result, the slide-and-friction roller 45 rotates in the same direction as the rotation direction of the photosensitive drum 14 at the abutment surface with the photosensitive drum 14. At this time, the slide-and-friction roller 45 slides over the surface of the photosensitive drum 14. At this time, in addition, the slide-and-friction roller 45 produces friction with the photosensitive drum 14. In this way, the slide-and-friction roller 45 removes residual toner from the surface of the photosensitive drum 14 and at the same time polishes the surface of the photosensitive drum 14 (the surface of the surface protective layer) by using the residual toner. The toner supplied from the developing unit 16 is a polishing toner containing a polishing agent. The polishing toner adheres to the surface of the photosensitive drum 14 in conformity with the electrostatic latent image formed on the photosensitive drum 14. As a result, a toner image is formed. In addition, the polishing toner is also used for polishing the surface of the photosensitive drum 14. The polishing toner remaining on the surface of the photosensitive drum 14 is used for polishing.

The linear velocity of the slide-and-friction roller 45 is higher than that of the photosensitive drum 14. For example, the linear velocity of the slide-and-friction roller 45 is 1.2 times higher than the linear velocity of the photosensitive drum 14. As an example of its structure, the slide-and-friction roller 45 may adopt a structure in which, for example, a foam layer of EPDM rubber having an Asker C hardness of 55° is used as a roller body wrapped around a metal shaft.

The material of the roller body is not limited to the EPDM rubber mentioned above. The roller body may be made of rubber or foam rubber of a different material. As the material of the roller body, one having an Asker C hardness ranging from 10° to 90° is suitably used. Note that Asker C is one of the durometers (spring type hardness meters) specified in the standard by the Society of Rubber Science and Technology, Japan. In short, Asker C is a device for measuring hardness (hardness meter). The Asker C hardness refers to a hardness measured by Asker C, and a greater value of Asker C hardness indicates material of higher hardness.

The cleaning blade 47 is disposed downstream from the slide-and-friction roller 45 in the rotation direction of the photosensitive drum 14 at the abutment surface between the slide-and-friction roller 45 and the photosensitive drum 14. The cleaning blade 47 is secured in abutment with the photosensitive drum 14. In one example of the cleaning blade 47, a blade made of polyurethane rubber having a JIS hardness of 78° is used. The cleaning blade 47 is secured so as to form a predetermined angle with the tangent to the surface of the photosensitive drum 14 at the point of abutment between the cleaning blade 47 and the photosensitive drum 14. The cleaning blade 47 removes toner remaining on the surface of the photosensitive drum 14 (residual toner) from the surface of the photosensitive drum 14. The material of the cleaning blade 47, the hardness of the cleaning blade 47, the dimensions of the cleaning blade 47, the amount by which the cleaning blade 47 bites into the photosensitive drum 14, the pressure under which the cleaning blade 47 is pressed against the photosensitive drum 14, and so on may be appropriately set according to the specifications of the photosensitive drum 14. Note that the JIS hardness refers to the hardness specified in the Japanese Industrial Standards (JIS).

The toner collecting roller 50 rotates in the clockwise direction in FIG. 2 while staying in contact with the surface of the slide-and-friction roller 45. By this action, the toner collecting roller 50 collects toner and the like adhered to the slide-and-friction roller 45. The toner and the like collected by the toner collecting roller 50 are then scraped off from the surface of the toner collecting roller 50 by a scraper (not shown). The residual toner removed from the surface of the photosensitive drum 14 by the cleaning blade 47 is ejected to the outside of the cleaning unit 17 by a collecting spiral (not shown). The toner and the like scraped off from the surface of the toner collecting roller 50 is similarly ejected to the outside of the cleaning unit 17 by the collecting spiral.

The transfer roller 18 transfers the toner image formed on the surface of the photosensitive drum 14 to the sheet P being conveyed along the sheet conveyance path 4, without disturbing the toner image. The transfer roller 18 is connected to a transfer bias supply and also to a bias control circuit (both not shown). By the transfer bias supply and the bias control circuit, a transfer bias which is of a reversed polarity to the toner is applied to the transfer roller 18.

The sheet conveyance path 4 has a conveyance surface that is formed by a conveyance-path resin member 51. A heating element 53 is disposed on the conveyance-path resin member 51. The heating element 53 heats the photosensitive drum 14. In FIG. 2, the contact point O2 is where the photosensitive drum 14 contacts the transfer roller 18. When L1 is defined as the straight line passing through the rotation center O1 of the photosensitive drum 14 and the contact point O2, the heating element 53 is located at the opposite side from the developing unit 16 across the straight line L1 (on the left-hand side of FIG. 2). In other words, the developing unit 16 is disposed upstream from the contact point O2 in the sheet conveyance direction, whereas the heating element 53 is disposed downstream from the contact point O2 in the sheet conveyance direction.

As described above, the heating element 53 that heats the photosensitive drum 14 is disposed outside the photosensitive drum 14. Therefore, a sliding electrode is no longer required to connect the heating element 53 to the power supply, and thus the risk of connection failure is eliminated. In addition, since the heating element 53 is disposed at the opposite side from the developing unit 16 across the straight line L1, heat generated by the heating element 53 is conducted less easily to the developing unit 16. This is effective to prevent caking and blocking of the toner in the developing unit 16.

In addition, the heating element 53 is accommodated in a concave portion 51*a* formed in the conveyance-path resin member 51. The concave portion 51*a* is located closer to the transfer roller 18 than to the photosensitive drum 14. Such disposition of the heating element 53 ensures that the heating element 53 does not obstruct the conveyance of the sheet P along the sheet conveyance path 4. Such disposition is also effective in that the heating element 53 is more distant from the cleaning unit 17. Thus, caking and blocking of the waste toner in the cleaning unit 17 can be prevented.

In addition, in the image forming apparatus 100 of a horizontal conveyance type as shown in FIG. 1, the heating element 53 is located below the photosensitive drum 14 (at the side of the transfer roller 18) across the sheet conveyance path 4 at all times. In this case, when the heating element 53 is conducted to warm up the ambient air, the warmed air travels upward by convection to arrive at the photosensitive drum 14. Therefore, the temperature of the photosensitive drum 14 is raised more efficiently as compared to the case where the heating element 53 is located above the transfer roller 18 (at the side of the photosensitive drum 14) across the sheet conveyance path 4.

Figure 4:
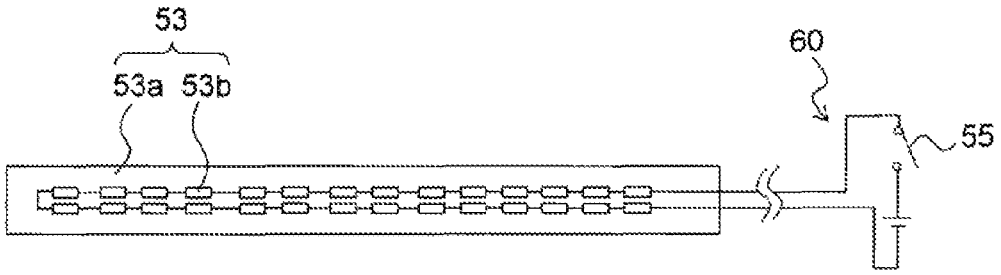
FIG. 4 is a plan view showing a structure of a heating element according to the first embodiment.

As shown in FIG. 3, the heating element 53 includes a substrate 53*a* and a plurality of resistor chips 53*b* (see FIG. 4). The plurality of resistor chips 53*b* are mounted on one main surface of the substrate 53*a* (the main surface on the right-hand side of FIG. 3). Hereinafter, the one main surface of the substrate 53*a* is referred to as the resistor-chip mounting surface. None of the resistor chips 53*b* is mounted on the other main surface of the substrate 53*a* (the main surface on the left-hand side of FIG. 3), the other main surface being the opposite side from the resistor-chip mounting surface. The heating element 53 is disposed such that the other main surface of the substrate 53*a* faces the first inner wall surface of the concave portion 51*a* opposite from the transfer roller 18 and that the resistor-chip mounting surface of the substrate 53*a* faces the second inner wall surface of the concave portion 51*a*, the second inner wall surface being closer toward the transfer roller 18. In addition, the resistor-chip mounting surface is disposed to have a predetermined gap from the second inner wall surface of the concave portion 51*a*. In this embodiment, a partition wall 51*b* is disposed to face the resistor-chip mounting surface, and a predetermined gap is secured between the resistor-chip mounting surface and the partition wall 51*b*.

In this way, the substrate 53*a* is located between the resistor chips 53*b* and the first inner wall surface of the concave portion 51*a*. Therefore, the temperature rise of the inner wall surfaces of the concave portion 51*a* is lessened. In addition, since the space is left between the resistor-chip mounting surface and the partition wall 51*b*, the air warmed by heat generated by the resistor chips 53*b* is assisted to flow toward the photosensitive drum 14 (upward in FIG. 3). The distance between the resistor-chip mounting surface and the partition wall 51*b* is preferably equal to the thickness of the substrate 53*a* (1.6 mm, in this case) or greater.

As shown in FIG. 3, a separation needle 54 is disposed downstream from the transfer roller 18 in the sheet conveyance direction (the direction from right to left in FIG. 2). The separation needle 54 is connected to a high-voltage supply (not shown). Therefore, the sheet P conveyed along the sheet conveyance path 4 is electrically attracted to the separation needle 54 and thus comes to be separated from the photosensitive drum 14. The separation needle 54 is secured to the second inner wall surface of the concave portion 51*a*. The partition wall 51*b* is disposed between the separation needle 54 and the heating element 53. This arrangement can prevent the heating element 53 from being damaged due to electric discharge from the separation needle 54 to the heating element 53.

FIG. 4 is a plan view showing a structure of the heating element 53. As stated above, the heating element 53 includes the substrate 53*a* and the plurality of resistor chips 53*b* disposed on the substrate 53*a*. The substrate 53*a* is longer in the axial direction of the photosensitive drum 14 (the direction perpendicular to the plane of FIG. 2). The temperature of the resistor chips 53*b* may rise nearly up to the heat-resistant temperature of synthetic resin. Therefore, for the substrate 53*a*, it is preferable to use a material having a low thermal conductivity, such as a glass epoxy resin (for example, CCL-EL190T manufactured by MITSUBISHI GAS CHEMICAL COMPANY, INC.). When the substrate 53*a* is formed from a material having a thermal conductivity lower than that of the conveyance-path resin member 51, heat of the resistor chips 53*b* is conducted less easily to the conveyance-path resin member 51 via the substrate 53*a*. As a result, the temperature rise of the conveyance-path resin member 51 is reduced. As the materials of the conveyance-path resin member 51 and the substrate 53*a*, examples satisfying the above conditions include: a polyphenylene sulfide (PPS) resin (for example, A310MX04 manufactured by Toray Industries, Inc. and having a thermal conductivity of 0.57 W/(m·k)) for the conveyance-path resin member 51, and a paper phenolic resin (for example, PLC-2147AQ manufactured by Sumitomo Bakelite Co., Ltd. and having a thermal conductivity of 0.25 W/(m·k)).

To prevent occurrence of image deletion on the photosensitive drum 14, it has been empirically confirmed that the relative humidity in the vicinity of the photosensitive drum 14 needs to be 60% or below. When the outside air temperature is from 10° C. to 40° C. and the relative humidity is 80%, keeping the relative humidity in the vicinity of the surface of the photosensitive drum 14 below 60% requires that the surface temperature of the photosensitive drum 14 be raised higher than the atmospheric temperature by 6° C. The output power of the heating element 53 required for raising the temperature by 6° C. or more is on the order of 1 W to 3 W.

For example, by providing as the resistor chips 53*b* twenty-eight 10Ω resistor chips on the substrate 53*a* and supplying 24 volts direct current, the heating element 53 achieves the output power of 2.05 W.

In addition, the heating element 53 is connected to a power supply circuit 60. The power supply circuit 60 is provided with a switch 55 that can be turned on and off. The switch 55 turns off the conduction of electric current to the heating element 53 during the heating period (conduction period) of the heating roller 22 of the fixing unit 10 (see FIG. 1) and turns on the conduction of electric current to the heating element 53 during the non-heating period (non-conduction period) of the heating roller 22. This ensures to avoid concurrent heat generation by the heating roller 22 and the heating element 53.

Therefore, excessive temperature rise in the image forming apparatus 100 can be prevented and power consumption can be saved. Note that the heating of the heating roller 22 is performed at the time of image forming and warm-up of the image forming apparatus 100.

Preferably, the conveyance-path resin member 51 is made from a material having a relative temperature index (hereinafter, RTI) greater than the surface temperature of the heating element 53. The RTI is an index of degradation of the mechanical characteristics (tensile strength and tensile impact strength) and the electrical characteristics (disruptive strength) after prolonged use in an environment associated with exposure to high temperature. The RTI is defined based on UL 746B (the UL Standard for Safety for Polymeric Materials—Long Term Property Evaluations) by Underwriters Laboratories Inc. in the United States of America. For example, a resin having an RTI of 110 means that the resin will have 50% of the initial mechanical characteristics and of the initial electrical characteristics after a 100,000—hour exposure at 110° C. Thus, by keeping the surface temperature of the heating element 53 below the RTI of the conveyance-path resin member 51, the mechanical characteristics and the electrical characteristics of the conveyance-path resin member 51 can be maintained until the end of the useful life of the image forming apparatus 100.

In addition to the polyphenylene sulfide resin mentioned above, examples of the material usable for the conveyance-path resin member 51 include modified-polyphenyleneether (m-PPE) (for example, Xyron SZ800 manufactured by Asahi Kasei Chemicals Corporation).

In addition, the heating element 53 is not conducted at the time of power-up of the image forming apparatus 100. When the conduction of electric current to the heating element 53 is turned on simultaneously with the power-up, the output power of the heating element 53 is low and requires three to four hours until the surface temperature of the photosensitive drum 14 is raised by 6° C. Therefore, when image formation is performed immediately after the power-up under the condition that the relative humidity inside the image forming apparatus 100 is 60% or higher, image deletion may occur. To prevent such occurrence of image deletion, it is preferable to perform drum refresh immediately after the power-up.

The following is an example of a specific method for the drum refresh. First, toner is ejected toward the photosensitive drum 14 from the developing roller 16*a* included in the developing unit 16. Then, the photosensitive drum 14 and the slide-and-friction roller 45 rotate for a predetermined period of time. Consequently, the surface of the photosensitive drum 14 (the surface of the surface protective layer) is polished by the toner present between the photosensitive drum 14 and the slide-and-friction roller 45.

Figure 5:
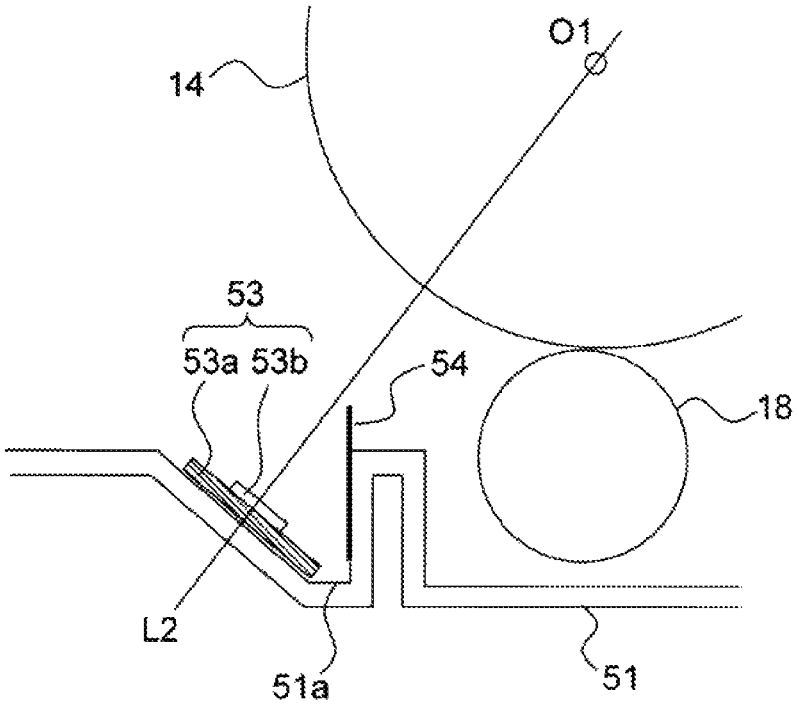
FIG. 5 is a view showing another example of the disposition of the heating element according to the first embodiment.

FIG. 5 is view showing another disposition of the heating element 53. FIG. 5 shows, on an enlarged scale, a portion around the nip portion that is formed at the contact point between the photosensitive drum 14 and the transfer roller 18. In FIG. 5, the first inner wall surface of the concave portion 51*a* facing the substrate 53*a* of the heating element 53 (the first inner wall surface positioned at the downstream side in the sheet conveyance direction) is an inclined surface. The inclined surface is sloped such that a straight line L2 perpendicular to the inclined surface passes though the rotation center O1 of the photosensitive drum 14. Consequently, the substrate 53*a* is at a position that would be projected on the surface of the photosensitive drum 14. The substrate 53*a* of the heating element 53 is disposed along the inclined surface.

With this structure, the photosensitive drum 14 is heated by convection of air warmed by the heating element 53 and also directly by radiant heat from the resistor chips 53*b*. Thus, the photosensitive drum 14 is more efficiently heated as compared to the disposition of the heating element 53 shown in FIG. 2. Further, since the gap between the heating element 53 and the separation needle 54 is wider, electric discharge from the separation needle 54 to the heating element 53 is reduced.

Figure 6:
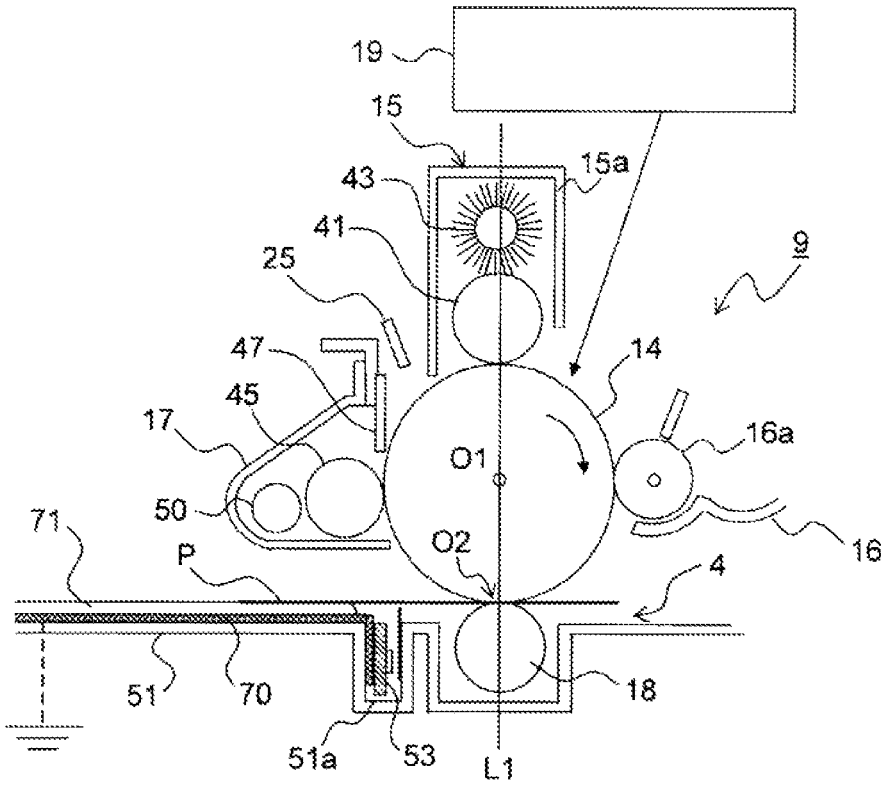
FIG. 6 is a schematic enlarged view showing a portion surrounding an image forming section according to a second embodiment.
Figure 7:
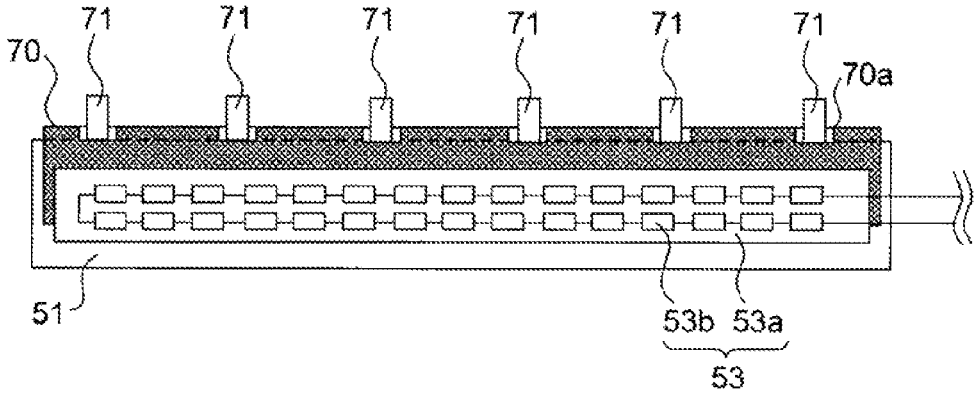
FIG. 7 is a view showing a heating element and a conveyance metal plate according to the second embodiment.

FIG. 6 is a schematic enlarged view showing a portion surrounding an image forming section 9 according to a second embodiment. FIG. 7 is a view showing a heating element 53 and a conveyance metal plate 70 according to the second embodiment. FIG. 7 shows the heating element 53 and the conveyance metal plate 70 as viewed from the right direction of FIG. 6. The following now describes the second embodiment with reference to FIGS. 6 and 7, by describing the differences with the first embodiment.

As shown in FIG. 6, the conveyance metal plate 70 extends along the conveyance-path resin member 51 from the first inner wall surface of the concave portion 51*a* that is positioned at the downstream side in the sheet conveyance direction (the inner wall surface on the left-hand side of FIG. 6) to a downstream position in the sheet conveyance direction. In addition, the conveyance-path resin member 51 is provided with a plurality of ribs 71. The ribs 71 protrude beyond the surface of the conveyance metal plate 70.

As shown in FIG. 7, the conveyance metal plate 70 has a plurality of (6, in this embodiment) openings 70*a* in a portion along the sheet conveyance direction. Each opening 70*a* is elongated in the sheet conveyance direction. The plurality of (6, in this example) ribs 71 are formed integrally with the conveyance-path resin member 51 on its surface along the sheet conveyance direction (top surface). Each rib 71 protrudes into the sheet conveyance path 4 through a corresponding one of the openings 70*a*. In addition, the substrate 53*a*, which is a component of the heating element 53, is secured to a portion of the conveyance metal plate 70, the portion extending along the concave portion 51*a*. More specifically, the substrate 53*a* is secured to the conveyance metal plate 70 at the main surface of the substrate 53*a* on which the resistor chips 53*b* are not mounted, the main surface being the opposite side from the resistor-chip mounting surface.

In the second embodiment, the sheet P is charged by the transfer bias applied to the transfer roller 18 and thus electrically attracted to the conveyance metal plate 70 that is disposed on the upper surface of the conveyance-path resin member 51. This ensures that the sheet P is attracted toward the upper surface of the conveyance-path resin member 51 and thus smoothly conveyed along the conveyance-path resin member 51. Each rib 71 is disposed on the top surface of the conveyance-path resin member 51 and protrudes beyond the surface of the conveyance metal plate 70. This arrangement keeps the sheet P out of direct contact with the conveyance metal plate 70 and eliminates the risk of bias current flowing into the conveyance metal plate 70.

In addition, the conveyance metal plate 70 is formed from a material having a higher thermal conductivity than that of the conveyance-path resin member 51, and the substrate 53*a* of the heating element 53 is secured to the conveyance metal plate 70. Examples of the usable materials include: an electrolytic zinc-coated steel sheet (SECC) manufactured by Sumitomo Metal Industries, Ltd. and having a thermal conductivity of 50.0 W/(m·k) for the conveyance metal plate 70; Xyron SZ800 manufactured by Asahi Kasei Chemicals Corporation and having a thermal conductivity from 0.16 W/(m·k) to 0.20 W/(m·k)) for the conveyance-path resin member 51; and CCL-EL190T manufactured by MITSUBISHI GAS CHEMICAL COMPANY, INC. and having a thermal conductivity of 0.45 W/(m·k) for the substrate 53*a*.

Use of such materials enables the conveyance metal plate 70 to function as a heat-dissipating plate (heat sink), so that the conveyance metal plate 70 efficiently dissipates heat conducted from the resistor chips 53*b* to the substrate 53*a*. Thus, deterioration and damage of the substrate 53*a* by heat can be reduced.

The present disclosure is not limited to the first or second embodiment described above, and various modifications are possible without departing from the gist of the present disclosure. For example, alternatively to the charging unit 15 of a contact charging type that includes the charging roller 41 as shown in FIG. 2, a charging unit of a corona charging type may be used. The charging unit of a corona charging type includes a corona wire and a grid. In addition, alternatively to the developing unit 16 of a one-component development type, a developing unit of a two-component development type may be used. The developing unit of a two-component development type uses a two-component developing agent containing toner and magnetic carrier.

In addition, the image forming apparatus according to the present disclosure is not limited to a monochrome printer as shown in FIG. 1. Alternatively, the present disclosure may be applicable to any other image forming apparatuses, such as monochrome copiers, color copiers, digital multifunctional peripherals, color printers, facsimile machines, and so on. The following now specifically describes advantageous effects of the present disclosure by way of Examples.

EXAMPLES

The image forming apparatuses 100 as shown in FIG. 1 were installed in the environments of 10° C./80%, 25° C./80%, and 35° C./80%. Each image forming apparatus 100 included the heating element 53 disposed in the concave portion 51*a* of the conveyance-path resin member 51 as shown in FIG. 2. The image forming apparatuses 100 were used in the respective environments to produce 200 prints of an image with the coverage rate of 4%. Thereafter, the image forming apparatuses 100 were left to stand for 48 hours in the respective environments. During the 48-hour time period, each image forming apparatus 100 was placed in the state in which electric power was supplied only to the heating element 53 and not to any other portions.

After the 48-hour period, each image forming apparatus 100 was used to produce prints of a test image containing both characters and a half-tone image. The first print of the test image was visually inspected for occurrence of image deletion. As Comparative Examples, the same experiment was conducted on image forming apparatuses having the same structure as the image forming apparatuses 100 except that the heating element was not mounted. Tables 1 and 2 below show the experimental results (evaluation results).

TABLE 1

| Environmental conditions | | Occurrence of Image deletion | |
|---|---|---|---|
| Temperature (° C.) | Relative humidity (%) | Characters | Half-tone image |
| 10 | 80 | Yes | Yes |
| 25 | 80 | Yes | Yes |
| 35 | 80 | Yes | Yes |

TABLE 2

| Environmental conditions | | Occurrence of Image deletion | |
|---|---|---|---|
| Temperature (° C.) | Relative humidity (%) | Characters | Half-tone image |
| 10 | 80 | No | No |
| 25 | 80 | No | No |
| 35 | 80 | No | No |

Table 1 shows the evaluation results on the apparatuses each without the heating element 53, whereas Table 2 shows the evaluation results on the apparatuses each with the heating element 53. As Table 1 indicates, Comparative Examples employing the image forming apparatuses without the heating element 53 were used in the high-humidity environment with the relative humidity of 80%, and all resulted in image deletion occurred in both the characters and the half-tone image irrespective of the temperatures. On the other hand, as Table 2 indicates, the image forming apparatuses 100 each with the heating element 53 were used in the high-humidity environment with the relative humidity of 80%, and all capable of preventing occurrence of image deletion in both the characters and the half-tone image irrespective of the temperatures.

What is claimed is:

1. An image forming apparatus comprising:

an image bearing member including a photosensitive layer;

a charging unit configured to charge a surface of the photosensitive layer by applying a charging bias to the surface of the photosensitive layer;

a laser scanning unit configured to form an electrostatic latent image on the photosensitive layer by scanning light on the surface of the photosensitive layer, the surface having been uniformly charged by the charging unit;

a developing unit that includes a developing-agent bearing member having an outer peripheral surface and configured to bear a developing agent on the outer peripheral surface, the developing unit being configured to form on a surface of the image bearing member a toner image conforming to the electrostatic latent image by using the developing-agent bearing member to cause toner to adhere to the surface of the image bearing member;

a transfer member configured to transfer the toner image formed on the surface of the image bearing member by the developing unit to a recording medium;

a recording medium conveyance path disposed between the transfer member and the image bearing member such that the recording medium is conveyed therethrough, the recording medium conveyance path including a resin member forming a conveyance surface, the resin member having a concave portion at a location closer to the transfer member than to the image bearing member;

a heating element accommodated in the concave portion and configured to heat the image bearing member, the heating element being located downstream from a contact point between the image bearing member and the transfer member in a conveyance direction in which the recording medium is conveyed through the recording medium conveyance path; and a cleaning unit configured to remove residual toner from the surface of the image bearing member, wherein the charging unit, the developing unit, the transfer member, and the cleaning unit are disposed in the stated order in a rotation direction of the image bearing member, and the developing unit is located upstream from the contact point between the image bearing member and the transfer member in the conveyance direction of the recording medium.

2. An image forming apparatus according to claim 1, wherein the heating element includes a substrate and a plurality of resistor chips, the plurality of resistor chips being mounted exclusively on one main surface of the substrate, and the heating element is disposed such that the substrate has the one main surface facing the image bearing member or the transfer member and an other main surface facing away from the image bearing member or the transfer member.

3. An image forming apparatus according to claim 2, wherein the heating element is disposed at a location such that a line perpendicular to the substrate surface is projected on the surface of the image bearing member.

4. An image forming apparatus according to claim 2, wherein the substrate is made from a material having a thermal conductivity equal to or lower than a thermal conductivity of the resin member.

5. An image forming apparatus according to claim 1, wherein the resin member has a relative temperature index that is higher than a surface temperature of the heating element during heating.

6. An image forming apparatus according to claim 2, further comprising a conveyance metal plate extending from an inner wall surface of the concave portion to a location downstream in the conveyance direction of the recording medium along an upper surface of the resin member, wherein the other main surface of the substrate is secured to the conveyance metal plate.

7. An image forming apparatus according to claim 6, wherein the conveyance metal plate has a thermal conductivity that is higher than both a thermal conductivity of the substrate and a thermal conductivity of the resin member.

8. An image forming apparatus according to claim 6, further comprising a rib disposed on the upper surface of the resin member, the rib protruding beyond a surface of the conveyance metal sheet.

9. An image forming apparatus according to claim 1, further comprising a fixing unit that includes a heating member configured to generate heat upon conducting an electric current, and a pressure member pressed against the heating member, the fixing unit being configured to perform fixing of the toner image transferred to the recording medium by the transfer member when the recording medium passes through a nip portion formed between the heating member and the pressure member, wherein when the heating member is conducting an electric current, conduction of electric current to the heating element is turned off, and when the heating member is not conducting an electric current, conduction of the electric current to the heating element is turned on.

10. An image forming apparatus according to claim 1, wherein the cleaning unit includes a polishing member that is pressed against the surface of the image bearing member and configured to polish the surface of the image bearing member, and upon power-up of a main body of the image forming apparatus, the developing unit supplies a developing agent to the image bearing member, and the polishing member polishes the surface of the image bearing member.

* * * * *